United States Patent [19]

Kamitamari et al.

[11] Patent Number: 4,839,697

[45] Date of Patent: Jun. 13, 1989

[54] IMAGE FORMING APPARATUS

[75] Inventors: Manabu Kamitamari; Hiroyoshi Hayama, both of Osaka, Japan

[73] Assignee: Minolta Camera Kabushiki Kaisha, Osaka, Japan

[21] Appl. No.: 201,012

[22] Filed: Jun. 1, 1988

[30] Foreign Application Priority Data

Jun. 1, 1987 [JP] Japan ..... 62-138744
Jun. 1, 1987 [JP] Japan ..... 62-138745

[51] Int. Cl.[4] ..... G03G 15/00
[52] U.S. Cl. ..... 355/309; 355/316
[58] Field of Search ..... 355/3 SH, 3 TR, 14 SH, 355/47, 64

[56] References Cited

U.S. PATENT DOCUMENTS

| | | | |
|---|---|---|---|
| 3,751,156 | 8/1973 | Szostak et al. | 355/3 TR |
| 3,914,042 | 10/1975 | Watson | 355/3 TR |
| 4,257,700 | 3/1981 | Tsuda et al. | 355/3 TR |
| 4,302,093 | 11/1981 | Landa | 355/3 TR |
| 4,306,800 | 12/1981 | Kopp | 355/3 TR |

*Primary Examiner*—R. L. Moses
*Attorney, Agent, or Firm*—Burns, Doane, Swecker & Mathis

[57] ABSTRACT

An image forming apparatus which is provided with a sheet guide disposed adjacent to a transfer charger and is movable between the first position adjacent to a photosensitive drum and the second position away from the drum by function of a driver which is controlled by a controller. The controller actuates the driver for positioning the sheet guide at the first position when the rear end of a paper passes the transfer section.

The sheet guide disposed between the transfer section and fixing section is movable between the first position where the guide is lifted up from an ordinary paper feed path and the second position which constitutes an ordinary feed path by a function of a driver which is controlled by a controller. The controller actuates the driver for positioning the sheet guide at the first position before the leading end of a transfer paper is nipped by a pair of rollers at the fixing section.

10 Claims, 8 Drawing Sheets

IMAGE FORMING APPARATUS

BACKGROUND OF THE INVENTION

The present invention relates to an image forming apparatus in an electrophotographic copying machine, laser printer and the like, more particularly to an improved sheet guide device in an image section.

Conventionally, in the transfer section in such apparatus, a transfer charger 92 and a separation charger 93 are disposed opposite to a photosensitive drum 91, and a sheet guide 94 is fixed on the separation charger 93 as illustrated in FIG. 10. A transfer paper 95, which is used for image transfer, entered into the transfer section via register rollers 100 is then conveyed, after passing the chargers 92, 93 and the sheet guide 94, to a fixing section by a conveyor belt 96 and another sheet guide 97. The fixing section receives the transfer sheet 95 into the nip section between a heat roller 98 and a pressurized roller 99 pressed by the heat roller, and fix transferred images on the transfer paper 95.

Accordingly, the transfer paper 95 passed the transfer section reaches the fixing section smoothly passing through an ordinary paper feed path, and the dashes into the nip section between the heat roller 98 and the pressure roller 99. The rear end of transfer paper 95 becomes free right after it passed through a pair of register rollers 100 and passes the transfer section. However, a proper gap is required for the transfer paper 95 sufficiently enough to pass through between the sheet guide 94 and the photosensitive drum 91. When the rear end of transfer paper 95 passes the transfer section after slipping out of the register rollers 100, the rear portion of the transfer paper tends to hang down as shown by a phantom line in FIG. 10, and causes defective transfer as the paper is not held sufficiently thereby parting the photosensitive drum 91.

When the transfer paper dashes into the fixing section, the leading end of the paper first hits the heat roller 98, and the paper is bounced back by $\Delta S$ a moment by the shock as shown in FIG. 11, and it affects the rear portion of the paper 95 being transferred with vibration as in FIG. 12.

As the peripheral speed of the heat roller 98 is a little slower than the speed of the transfer paper being conveyed (the peripheral speed of the photosensistive drun 91), there form an arch cuerve at the leading end of the paper 95 as in FIG. 13 and it is transmitted to the transfer paper 95 being transfereed which is in contact with the drum 91 as illustrated in FIG. 14 resulting in some gap between the surface of drum 91 and the paper 95 as well as difference in speed, thereby causing defective transfer and thus spoil the quality of images transferred.

SUMMARY OF THE INVENTION

The first object of the present invention is to provide an image forming apparatus which prevents the rear end of transfer paper from parting from a photosensitive drum 91 though it tends to hang down after slipping out of register rollers thereby resolving the problems of aberration in transferring and defective image transfer. Thus, the image forming apparatus herein disclosed provides a sheet guide movably disposed adjacent to a transfer charger thereby moves between the first position adjacent to the drum and the second position away from the drum, a driving means for moving the sheet guide from the second position to the first position, and a controlling means for actuating the driving means for positioning the sheet guide at the first position when the rear end of transfer paper passes the transfer section.

The second object of the present invention is to provide an image forming apparatus which resolves the problems of aberration in transferring and defective image transfer arising from the shock and an arch curve formed at the leading end of a transfer paper when the paper dashes into fixing section. Thus, the image forming apparatus herein disclosed provides a sheet guide disposed at the downstream of the transfer section or at the upstream of the fixing section, and it is movable between the first position where the guide is lifted up from an ordinary paper feed path and the second position which constitutes an ordinary paper feed path, a driving means for moving the sheet guide from the second position to the first position, and a controlling means for actuating the driving means for positioning the sheet guide at the first position before the leading end of the transfer paper is nipped into a pair of rollers at the fixing section.

Further objects and features of the present invention will be better understood by reference to the following description, and to the drawings forming a part thereof.

The same mark are used for the common parts used in each embodiment.

DETAILED DESCRIPTION OF THE INVENTION

The first embodiment of the present invention will be described below with reference to the accompanying drawings. FIGS. 1 to 4 show an example of an electrophotographic copying machine.

Figure 4:
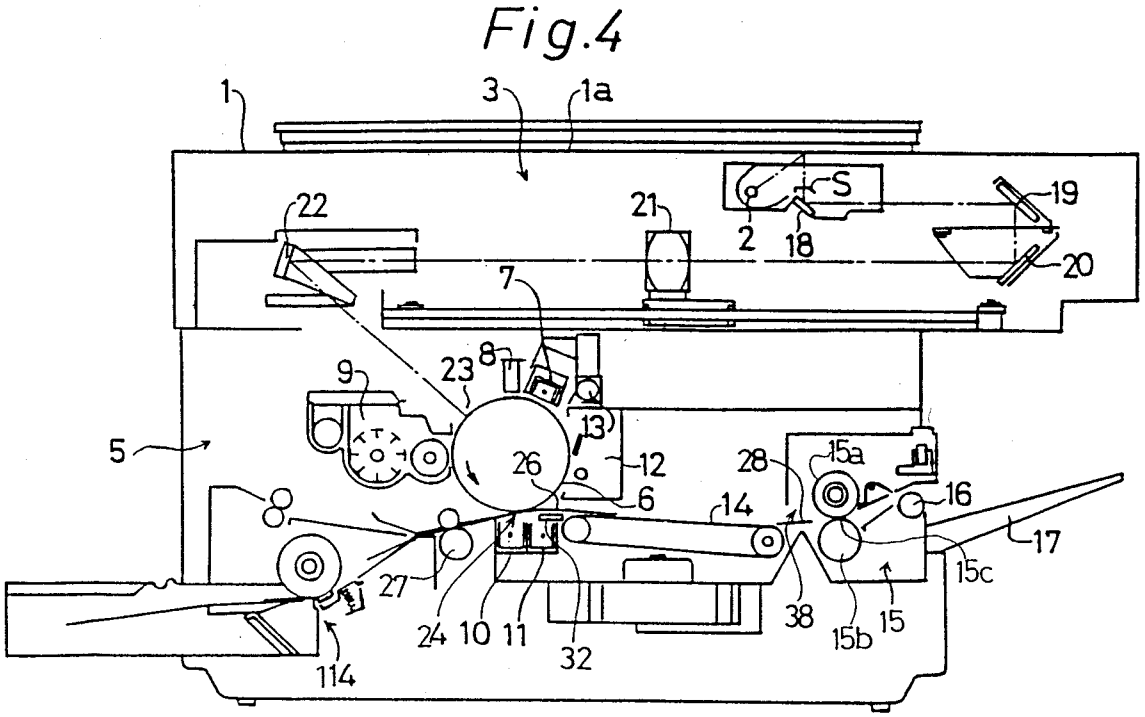
FIG. 4 is a schematic illustration of general structure of the electrophotographic coping machine which possesses the transfer section illustrated in FIGS. 1 and 2.

As illustrated in FIG. 4, a photosensitive drum 6 is disposed approximately in the center of the main body 5 of the copying machine and an image of an original placed on an original platform 1 is exposed onto the drum 6 by an exposure optical system 3 having a light source 2. Arranged around the drum 6 are charger 7, suberaser 8, exposure section 23, developing unit 9, transfer charger 10 and separation charger 11, cleaning unit 12 and eraser 13, all of which are disposed sequentially in the direction of movement of the drum thereby composing an image forming section.

On the left side of the main body 5 of the copying machine, paper feed section 114 is provided for feeding a transfer paper 26 to the contact gap between the photosensitive drum 6 and the transfer section including the transfer and separation charger 10, 11. The transfer paper 26 is fed via register rollers 27 simultaneously with the formation of a toner image on the drum 6, and the toner image is transferred onto the paper 26. After transferring, the transfer paper 26 is conveyed by a conveyer belt 14 to fixing section 15 via guide 28, and the copy fixed thereat is discharged by a discharge roller 16 onto a discharge tray 17 disposed on the right side of the main body 5 of the copying machine.

In the exposure optical system 3, the light source 2 travels together with a first mirror 18 and an exposure slit S at a speed of V/M (wherein M is magnification) against the peripheral speed V of the drum 6 and scans the original placed on the original support glass plate 1*a* on the original platform and exposes in sequential order through the first mirror 18, the second and third mirrors 19, 20 both of which travel at a speed of ½ of the first mirror 18, a projection lens 21 which travels each position of enlarged, reduced, same-size magnification, and fourth mirror.

Figure 1:
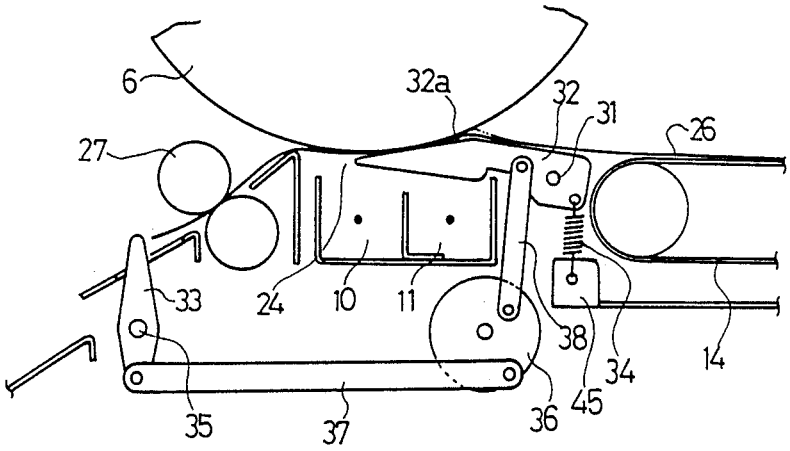
FIGS. 1 and 2 is a side view of transfer section of an electrophotographic copying machine illustrating the first embodiment of the present invention. Each figure shows the condition when a paper passes the transfer section.
Figure 2:
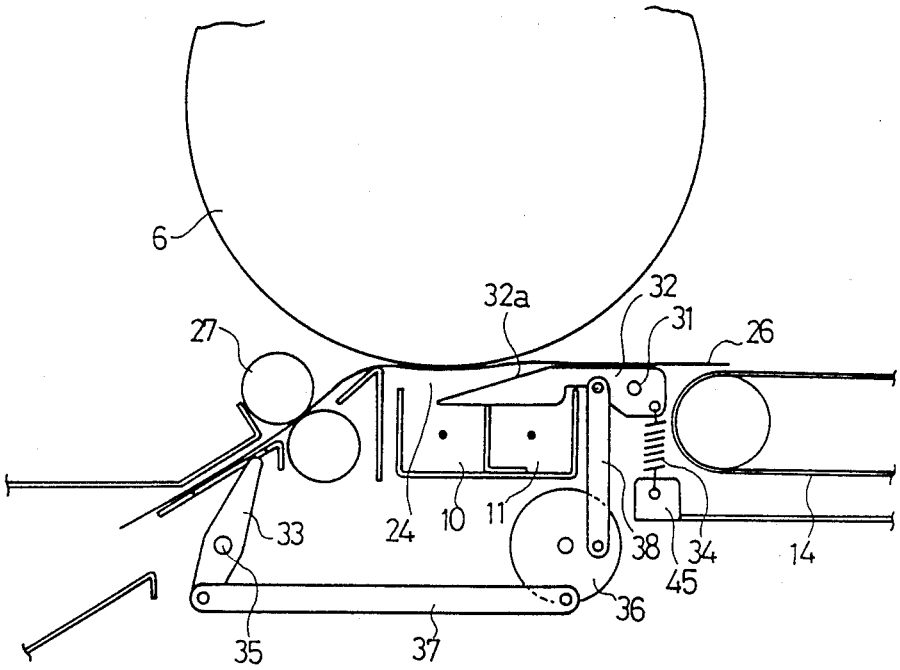
Figure 3:
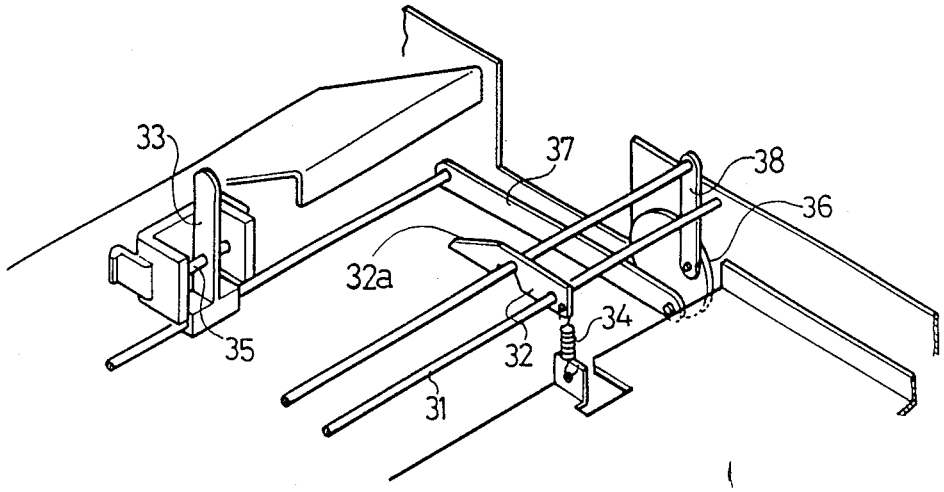
FIG. 3 is a perspective view showing a part of the transfer section illustrated in FIGS. 1 and 2.

In the transfer section 24, a sheet guide 32 is pivotally disposed with a shaft so as to rotate between the first position wherein the sheet guide 32 is located above an ordinary paper feed path and the second position wherein the sheet guide 32 is located along the ordinary paper feed path as illustrated in FIGS. 1 and 2, respectively. The sheet guide 32 provides inclined plane 32*a* on which the transfer peper 26 is smoothly conveyed and guided through conveyor belt 14 and guide 28 as shown in FIGS. 1 and 3. The sheet guide 32 is connected to a sheet detection lever 33 disposed in the front of the register rollers 27, and also to the leading end of a spring 34, and another end of which is fastened to a bracket 45 fixed on the main body.

The sheet detection lever 33 is pivotally disposed with a shaft 35 and connected to the sheet guide 32 with a rotating plate 36 which is provided for changing the direction of movement, and also with rods 37, 38 so as to locate the extruded position above the ordinary paper feed path when the sheet guide 32 is located in the first position.

The sheet guide 32 is a biased by the spring 34 to maintain the position of the sheet guide 32 above an ordinary paper feed path (the first position), and the sheet detection lever 33 is also biased to maintain the extruded position above the ordinary paper feed path at the front of the register rollers 27 by correlative movement with the sheet guide 32 as illustrated in FIG. 1. Hence, when the transfer paper 26 passes the area of the sheet detection lever 33 along the ordinary path, the lever 33 is pressed down against the spring 34 and coincidently holds down the sheet guide 32 to the lower position of the ordinary paper feed path (the second position) as illustrated in FIG. 2.

The successive movement of the device will be described below. Under the normal condition as shown in FIG. 1, when a transfer paper reaches register rollers 27, the sheet lever 33 is pressed down against the spring 34, and the sheet guide 32 is coincidently held down to the second position as illustrated in FIG. 2. Thus, the transfer paper 26 conveyed to the transfer section 24 via the register rollers 27 smoothly passes on the transfer charger 10, separation charger 11 and the sheet guide 32, and proceeds to an ordinary process for image transfer with the drum 6. The transfer paper passed through the transfer section 24 is then conveyed to the fixing section 15 along the ordinary paper feed path.

When the rear end of transfer paper being transferred comes off the detection lever 33, the sheet detection lever 33 is set upright to the normal position by the force of spring 34 as shown in FIG. 1. Corresponding to the movement, the sheet guide 32 is returned to the upper normal position, and presses the rear end portion of transfer paper 26 against the photosensitive drum 6. Therefore, even if the rear end of the transfer paper 26 tends to hang down after slipping out of the register rollers, the transfer sheet does not come off and no defective transfer occurs.

When the sheet guide 32 is kept at the upper transport position as shown in FIG. 1, the inclined place 32*a* is also positioned at the upper transport path, which consequently holds up a portion of the transfer paper 26 locally in the forwarding direction and bends the portion upward. Then, the paper 26 passes through the inclined plane 32*a* of the sheet guide 32 making an archlike curve thereon, and when the leading end of the paper enters into fixing section 15, it hits a heat roller 15*a* and thereafter proceeds to the nip section 15*c* between the heat roller 15*a* and a pressure roller 15*b* along the periphery of the heat roller 15*a* making an archlike curve thereon.

Although the shock and archlike curve made near the nip section 15*c* may affect the rear end of the paper being transferred by effects of the rebound and the vibration, they are absorbed by the archlike curve made on the inclined plane 32*a* of the guide 32 illustrated in FIG. 1, i.e. from the solid line to the phantom line, which solves the problem of defective transferring.

Although only a piece of the sheet guide 32 which is disposed perpendicularly to the direction of paper feed path within the area corresponding to the narrowest size of paper to be fed will be effective, disposition of a plurality of the sheet guides is preferable taking into account the widest size of paper to be fed. In using a plurality of the sheet guides 32, inclined plane 32*a* of the guide 32 holds up the transfer paper and forms a ridgeline perpendicularly to the direction of paper feed path thereby increasing the elasticity of the transfer paper, which consequently increase the absorbency for the rebound and the vibration described above.

With regard to the function of the sheet guide 32 when the transfer paper enters into the fixing section, it is effective only when the length of the transfer paper 26 is longer than the length between the fixing section and the transfer section 24.

Figure 5:
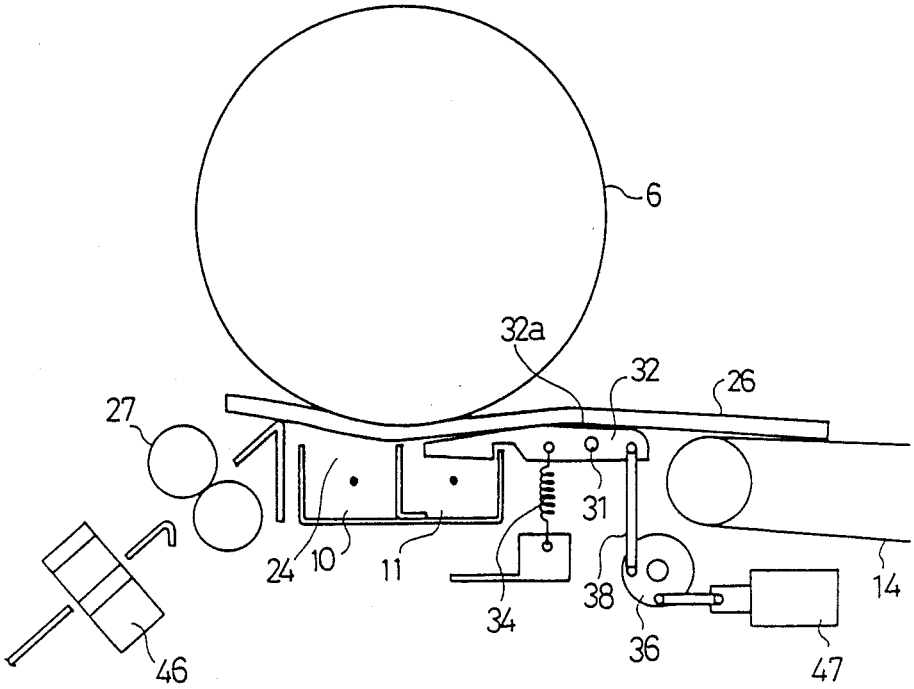
FIG 5 is a side view of transfer section showing another example of the first embodiment.

Any means for detecting a paper at the front of the register rollers 27 may be applicable; for instance, the utilization of a photo sensor 46 as in FIG. 5, or the means for changing the position of the sheet guide 32 in accordance with the sheet detection, or a solenoid 47 may be replaced with, in which case the time for changing the position of the sheet guide 32 can be set freely according to the requirement.

The second embodiment of the present invention illustrated in FIGS. 6 through 9 will be described below. As the basic structure of the electrophotographic copying machine in this embodiment is the same as the one described in the first embodiment, explanation on the structure is omitted.

Figure 6:
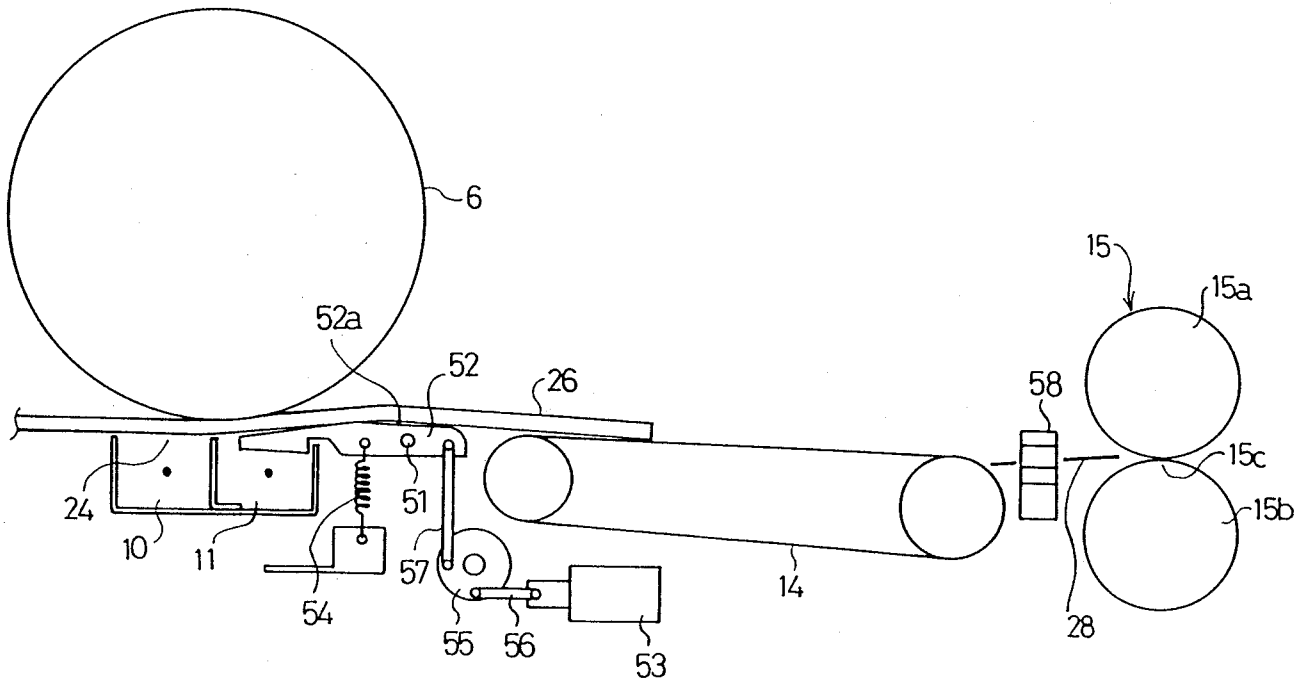
FIG. 6 is a side view of the section from transfer section to fixing section of an electrophotographic copying machine illustrating the second embodiment of the present invention and the condition when the leading end of a transfer paper passes the transfer section.
Figure 7:
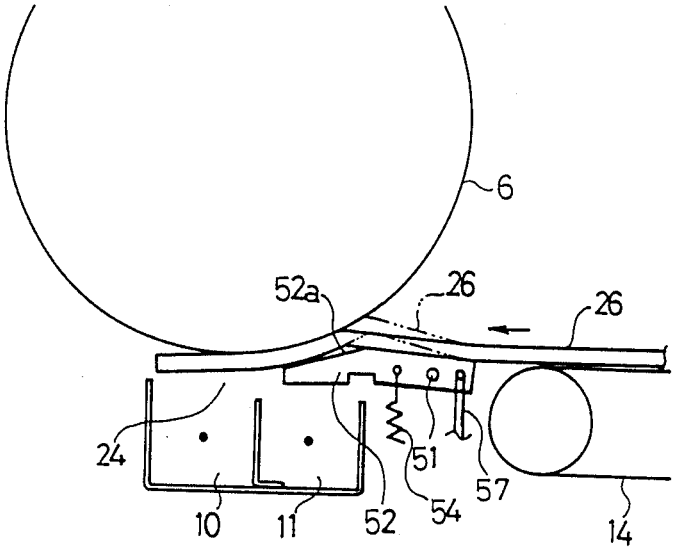
FIG. 7 is a side view showing the condition when the rear end of a transfer paper passes through the transfer section shown in FIG. 5.

In the transfer section 24, a sheet guide 52 is pivotally disposed with a shaft 51 as illustrated in FIGS. 6 and 7. The sheet guide 52 provides inclined plane 52*a* on which the transfer sheet 26 is smoothly conveyed and guided through the conveyor belt 14 and the guide 28 as shown in FIG. 6. The sheet guide 52 is connected to a solenoid 53 and to a spring 54, and while the solenoid 53 is off, the sheet guide 52 is biased by the spring 54 to maintain the position of the inclined plane 52*a* of the guide 52 under an ordinary transport path (the second position), and when the solenoid is put on, the inclined plane 52*a* of the guide 52 is actuated to position above an ordinary paper feed path (the first position) as illustrated in FIG. 7. The solenoid 53 is laid sideways and connected to the sheet guide 52 with a rotating plate 55 which is provided for changing the direction of movement, and also with rods 56 and 57.

In front of the fixing section 15, a photo sensor 58 is disposed to detect the transfer paper 26, which actuates the solenoid 53 when the photo sensor detects the leading end of the transfer paper 26 so that the position of the sheet guide 52 shown in FIG. 6 is changed to the position illustrated in FIG. 7.

When the sheet guide 52 is positioned as shown in FIG. 6, the inclined plane 52*a* is positioned under the ordinary paper feed path, thus the transfer paper 26 conveyed through the transfer section is smoothly conveyed and guided along the ordinary path. While, when the sheet guide 52 is positioned as in FIG. 7, the inclined plane 52*a* of the guide comes up above the ordinary path and holds up the portion of the transfer paper 26 locally in the forwarding direction, and bends the portion upward. Then, the transfer paper 26 passes through the inclined plane 32*a* of the sheet guide 32 making an archlike curve thereon, and when the leading end of the paper enters into the fixing section 15, it hits the heat roller 15*a* and thereafter proceeds to the nip section 15*c* between the heat roller 15*a* and the pressurized roller 15*b* along the periphery of the heat roller 15*a* making an archlike curve thereon.

The shock and the archlike curve caused near the nip section 15*c* may effect the rear end of the paper being transferred by effects of the rebound and the vibration. However, they are absorbed by the archlike curve made on the inclined plane 52*a* shown in FIG. 7, i.e. from the solid line to the phantom line, which solves the problems of defective transferring. By holding up the transfer paper 26 with the sheet guide 52, it protect the transfer paper from parting from the photosensitive drum 6 thereby eliminating the problem of defective transferring.

Although only a piece of the sheet guide 52 which is disposed perpendicularly to the direction of paper feed path within the arch corresponding to the narrowest size of paper to be fed will be effective, disposition of a plurality of sheet guides is preferable taking into account the widest size of paper to be fed. In using a plurality of the sheet guides 52, the inclined plane 52*a* of the guide holds up the transfer paper 26 and forms a ridgeline perpendicularly to the direction of paper feed path thereby increasing the elasticity of the transfer paper, which consequently increase the absorbency for the rebound, the vibration and transmission of the bend described above. With regard to the function of the sheet guide 52 when the transfer paper 26 enters into the fixing section, it is effective only when the length of the transfer paper 26 is longer than the length between the transfer section 24 and the fixing section.

Figure 8:
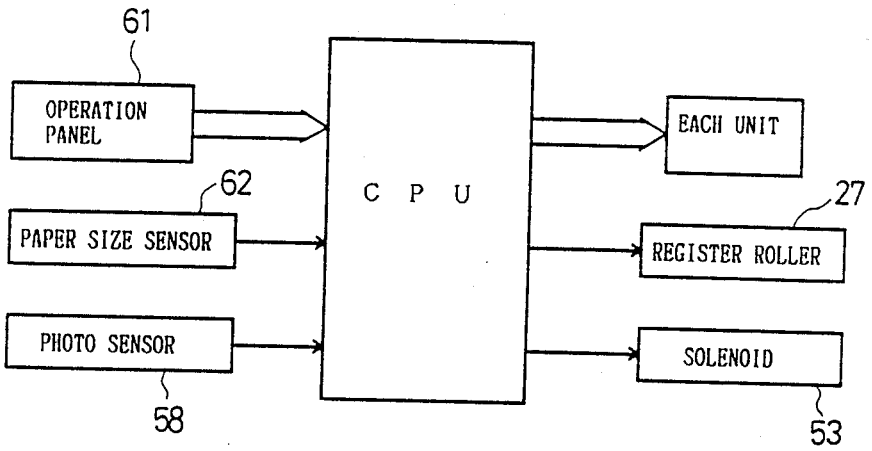
FIG. 8 is a block diagram of a control circuit.

In FIG. 8, various signals from operation panel 61 and the signals from photo sensor 58 are input in the CPU of microcomputer while inputting signals from paper size censor 62. The paper size sensor 62 consists of a read switch which detects the arrangement of a plurality of magnets disposed at the back of paper cassette, and distinguish the kind of paper cassette thereby judges the size of the transfer sheet in the cassette. On the other hand, the signals which control each unit, register roller 27 and the solenoid 53 are output from the CPU.

Figure 9:
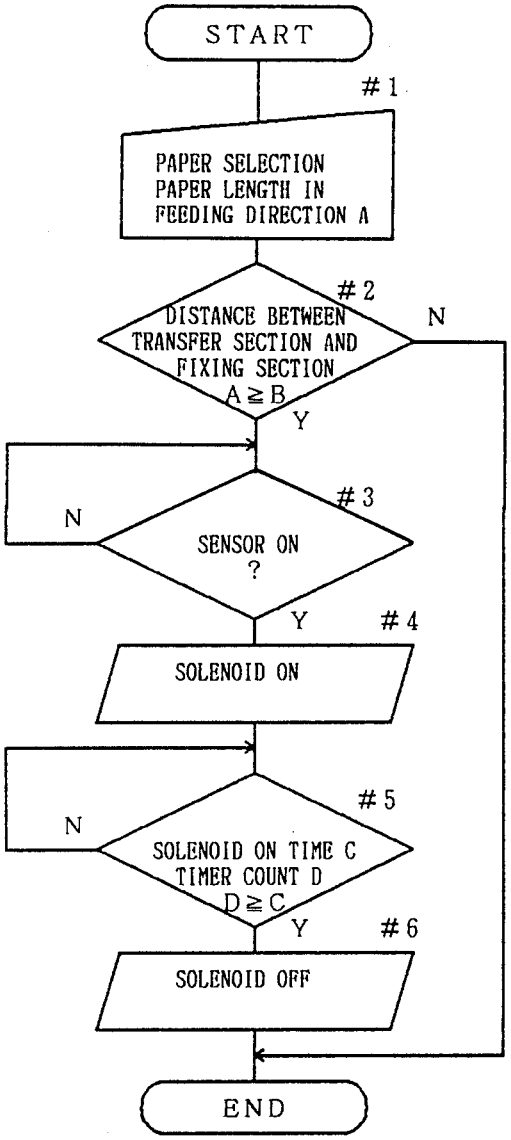
FIG. 9 is a flow chart showing the movement control by a solenoid for a sheet guide.
Figure 10:
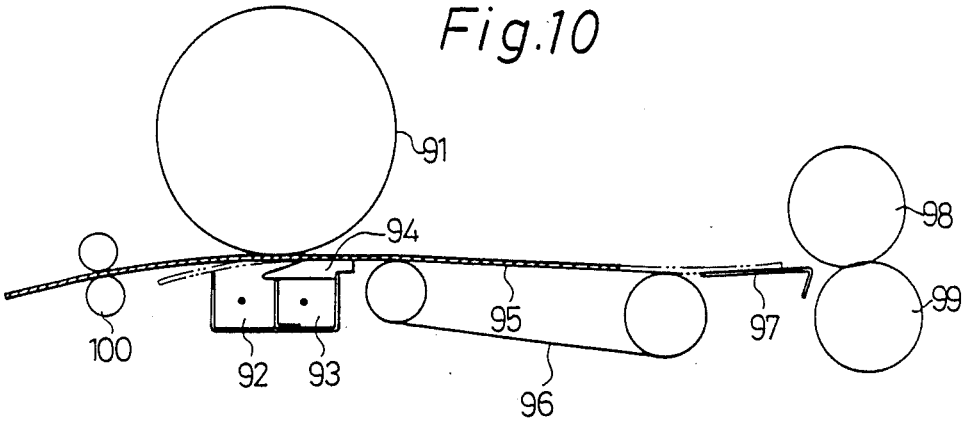
FIG. 10 is a side view showing the section from transfer section to fixing section of a conventional electrophotographic copying machine.
Figure 11:
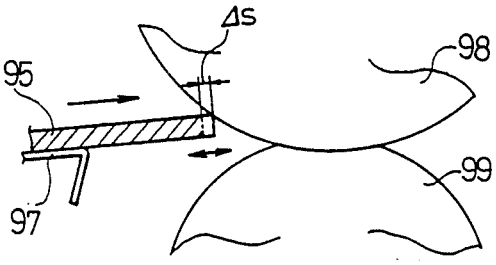
FIGS. 11 and 12 are fragmentary side views of transfer section and fixing section showing the initial condition when the transfer paper enters into the transfer section of FIG. 10.
Figure 13:
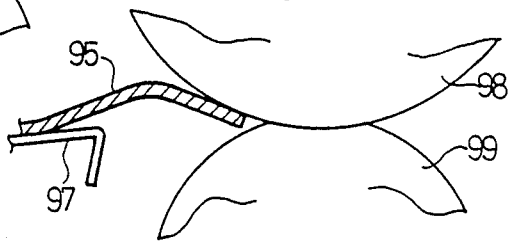
FIGS. 13 and 14 are fragmentary side views of transfer section and fixing section illustrating the secondary condition when a transfer paper enters into the fixing section shown in FIG. 10.
Figure 12:
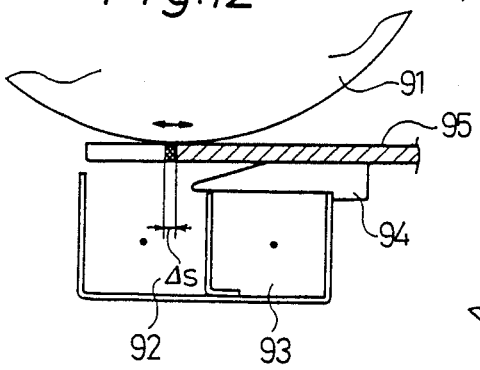
Figure 14:
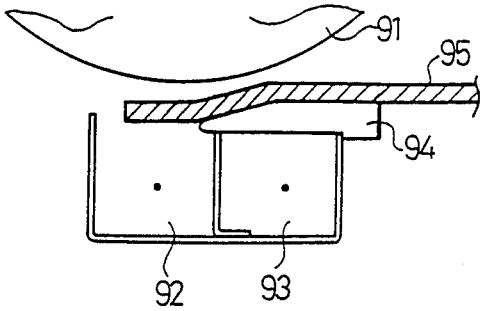

As in flow chart of FIG. 9, at step #1, paper size is distinguished basing on the data from the paper size sensor 62 and the length A of transfer paper 26 in the forwarding direction is set automatically. Then, at step #2, it distinguishes the length A paper whether it is equal to or longer than the length B between the transfer section 24 and the fixing section 15, then actuate the solenoid 53 at the timing when the photo sensor 58 detects the leading end of the paper transferred to the fixing section at steps #3 and #4.

The on-time C of the solenoid 53 covers the time the transfer sheet 26 enters into the nip section 15*c*, therefore, set the time adding some extra secure time to it, and makes it to off when the count time D is equal to or exceeds the on-time C.

The on-time of the solenoid is being decided by use of a timer. However, it may be possible to have the solenoid 53 on only when the photo sensor is detecting the existence of the transfer paper 26.

Both in the first and second embodiments, the position of transfer paper was detected by using sensor or lever, however, it is not limited to the method of the detection described. For, instance, it may actuate the solenoid 47, 53 on/off by running internal timer when print switch or register rollers are put on. It is preferable to set the setting time of internal switch according to the length of the transfer paper 26.

While the embodiments disclosed herein are preferred, it will be appreciated that they are merely examples, and that various alternatives, modifications, variations, or improvements may be made by those skilled in the art from this teaching, which are intend to be encompassed by the following or subsequent claims.

What is claimed is:

1. An image forming apparatus, comprising:

a rotatable photosensitive member;

means for forming an image on the photosensitive member;

means for transferring the image onto a paper, said transferring means including a transfer charger opposite to the photosensitive member to compose a transfer section;

feeding means provided in a paper feed path for feeding the paper through the transfer section;

a sheet guide provided in the transfer section movable between the first position adjacent to the photosensitive member and the second position away from the photosensitive member;

driving means for moving the sheet guide from the second position to the first position; and controlling means for actuating the driving means to position the sheet guide at the first position when the rear portion of the paper passes the transfer section.

2. An image forming apparatus as claimed in claim 1, wherein the control means actuates the driving means after the leading end of the paper passed through the transfer section.

3. Am image forming apparatus as claimed in claim 1, further comprising a lever which is movably disposed at the upstream of the transfer section in the paper feed path and is movable between the first position at which the lever is extruded in the paper feed path and the second position at which the lever is shifted away from the paper feed path, and a link mechanism for interconnecting the lever and the sheet guide so as to have the sheet guide positioned at the first position when the lever is at the first position.

4. An image forming apparatus as claimed in claim 1, wherein the control means includes a paper detecting means disposed at the upstream of the transfer section in the paper feed path, and actuates the driving means to position the sheet guide at the first position after said detecting means detects the paper passing.

5. An image forming apparatus, comprising:

a rotatable photosensitive member;

means for forming an image on the photosensitive member;

means for transferring the image onto a paper, said transferring means including a transfer charger opposite to the photosensitive member to compose transfer section;

feeding means provided in a paper feed path for feeding the paper through the transfer section;

fixing means provided at the downstream of the transfer section for fixing the transferred image on the paper and having a pair of rollers;

a sheet guide provided between the transfer section and the fixing means, said sheet guide being movable between the first position extruded from the paper feed path and the second position along the paper feed path;

driving means for moving the sheet guide from the second position to the first position; and controlling means for actuating the driving means to position the sheet guide at the first position before the leading end of the paper is nipped by the pair of rollers.

6. An image forming apparatus as claimed in claim 5, wherein the controlling means actuates the driving means after the paper passed on the sheet guide.

7. An image forming apparatus as claimed in claim 5, wherein said controlling means includes a paper detecting means disposed between the sheet guide and the fixing means and actuates the driving means at the time when the leading end of the paper passes the paper detecting means.

8. An image forming apparatus as claimed in claim 7, wherein the controlling means keeps the driving means actuating for a predetermined time after detecting the leading end of the paper.

9. An image forming apparatus as claimed in claim 7, wherein the controlling means keeps the driving means actuating while the paper is being detected.

10. An image forming apparatus as claimed in claim 5, further comprising:

detecting means for detecting the length of a paper, means for checking the operation of control means when the length of a paper is detected shorter than the length between the transfer section and the fixing means.

* * * * *